US005174735A

United States Patent [19]

Gannaway

[11] Patent Number: 5,174,735

[45] Date of Patent: Dec. 29, 1992

[54] LOW REEXPANSION VALVE SYSTEM

[75] Inventor: Edwin L. Gannaway, Adrian, Mich.

[73] Assignee: Tecumseh Products Company, Tecumseh, Mich.

[21] Appl. No.: 685,901

[22] Filed: Apr. 16, 1991

[51] Int. Cl.[5] ..... F04B 21/04

[52] U.S. Cl. ..... 417/550; 417/553; 417/570; 137/516.21

[58] Field of Search ..... 417/550, 552, 553, 569, 417/570; 137/516.17, 516.19, 516.21, 516.23

[56] References Cited

U.S. PATENT DOCUMENTS

| | | | |
|---|---|---|---|
| 1,764,655 | 11/1927 | Spreen | 137/533.19 |
| 1,996,763 | 4/1935 | Halleck | 417/569 |
| 2,158,351 | 5/1939 | Ames et al. | 230/221 |
| 2,199,452 | 5/1940 | Voss | 417/569 |
| 2,812,893 | 11/1957 | Cotter | 230/46 |
| 3,807,910 | 4/1974 | Paget | 417/564 |
| 3,971,407 | 7/1976 | Hudson et al. | 137/516.17 |
| 4,752,190 | 6/1988 | Fry | 417/238 |
| 4,834,632 | 5/1989 | Gatecliff et al. | 417/534 |
| 5,080,565 | 1/1992 | Schultz et al. | 417/550 |

FOREIGN PATENT DOCUMENTS

| | | | |
|---|---|---|---|
| 0506608 | 10/1954 | Canada | 137/516.17 |
| 58-2481 | 1/1983 | Japan . | |

*Primary Examiner*—Michael Koczo
*Assistant Examiner*—Charles G. Freay
*Attorney, Agent, or Firm*—Baker & Daniels

[57] ABSTRACT

A scotch yoke compressor including a valve system wherein an annular discharge port is defined by an opening in the valve plate and a washer attached to the cylinder head. A valved piston includes a valve retainer having an annular protuberance that extends above the piston head and is received within the annular discharge port when the piston is at top dead center, thereby reducing reexpansion volume.

9 Claims, 4 Drawing Sheets

LOW REEXPANSION VALVE SYSTEM

BACKGROUND OF THE INVENTION

The present invention relates generally to a reciprocating piston compressor assembly and, more particularly, to an improved valve system for such a compressor assembly, wherein a suction valve assembly associated with the piston interfits with a discharge port associated with the valve plate and cylinder head to reduce reexpansion volume in the cylinder.

In a typical reciprocating piston compressor, a cylinder is defined by a compressor crankcase and a piston reciprocates within the cylinder to compress gaseous refrigerant therein. In a compressor to which the present invention pertains, the piston comprises a piston valve assembly wherein the suction valve is operably mounted on the piston head to receive gas through the piston from one end of the cylinder and compress the gas in the cylinder for discharge out of the other end. A valve plate is mounted to the crankcase so as to close the top of the cylinder. The valve plate includes a discharge valve assembly operable to discharge gas into a discharge space defined by a cylinder head cover mounted to the crankcase with the valve plate disposed therebetween.

The present invention is particularly applicable to a scotch yoke compressor, wherein a plurality of radially arranged pistons are drivingly connected to a crankshaft by means of a scotch yoke mechanism within a suction cavity. An example of a scotch yoke compressor is found in U.S. Pat. No. 4,834,632 assigned to the assignee of the present invention and incorporated herein by reference.

The aforementioned patent discloses a scotch yoke compressor having piston suction valve assemblies wherein a valve retainer is attached to the piston by means of a centrally located fastener, the head of which is received within a recess in the valve plate to reduce the reexpansion volume. Such an assembly does not ordinarily reduce the reexpansion volume attributable to the discharge ports. In U.S. Pat. No. 1,764,655, a suction valve retainer is centrally mounted to the flat top surface of the piston, and extends therefrom and is received within a central round discharge port in the valve plate.

In prior art compressors having both discharge and suction valving associated with a compressor valve plate, it is known to use a piston having an annular upstanding portion on the piston head that fills a corresponding annular discharge port when the piston is at top dead center.

It is desired to provide an improved valve system for a compressor requiring a valved piston and having discharge valving associated with a valve plate, whereby reexpansion volume associated with a discharge port in the valve plate is minimized.

SUMMARY OF THE INVENTION

The present invention overcomes the disadvantages of the above-described prior art by providing an improved valve assembly wherein a valved piston includes a valve retainer having an annular protuberance that occupies an annular discharge port when at its top dead center position to reduce reexpansion volume. More specifically, a recess in the piston head and a counterbore in the valve retainer facilitate attachment of the retainer to the piston and accommodate the annular discharge valve to decrease reexpansion volume.

Generally, the invention provides a counterbore in the suction valve retainer that accommodates a central portion of the discharge valve assembly. Specifically, a valve washer and bolt are attached to the cylinder head and are received within the counterbore in the suction valve retainer.

The invention also provides for an annular protuberance on the suction valve retainer that interfits within the discharge port adjacent the discharge valve to reduce reexpansion volume.

An advantage of the present invention is that it substantially reduces the reexpansion volume of the cylinder during operation thereby making the compressor more efficient.

The invention, in one form thereof, provides a compressor valve system for a scotch yoke compressor. The valve system includes a discharge valve assembly connected to a cylinder crankcase, and a suction valve assembly on a top face of a reciprocating piston. The discharge valve assembly comprises an annular discharge valve overlying a discharge valve seat defined by a valve plate and a member suspended from a cylinder head cover. The suspended member fills a central opening in the valve plate, thereby creating an annular discharge port. The suction valve assembly includes a valve retainer having an annular protuberance that substantially fills the annular discharge port when the piston is at top dead center. The suction valve assembly also includes a suction valve, sealing over suction ports in the piston.

In one aspect of the previously described form of the invention, the suspended member comprises a washer attached by a bolt to the cylinder head. The washer creates the radially inner portion of the annular discharge port into which the protuberance of the suction valve retainer is received.

In accord with another aspect of the invention, the suction valve is indexed to prevent its rotation relative the suction valve retainer. Specifically, notches are provided in the suction valve retainer, and radially inwardly extending projections or tabs are provided on the inner periphery of the suction valve. The interfitting of the tabs into the notches prevents the suction valve from rotating relative the suction valve retainer.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates a preferred embodiment of the invention, in one form, and such exemplifications are not to be construed as limiting the scope of the invention in any manner.

DESCRIPTION OF THE PREFERRED EMBODIMENT

Figure 1:
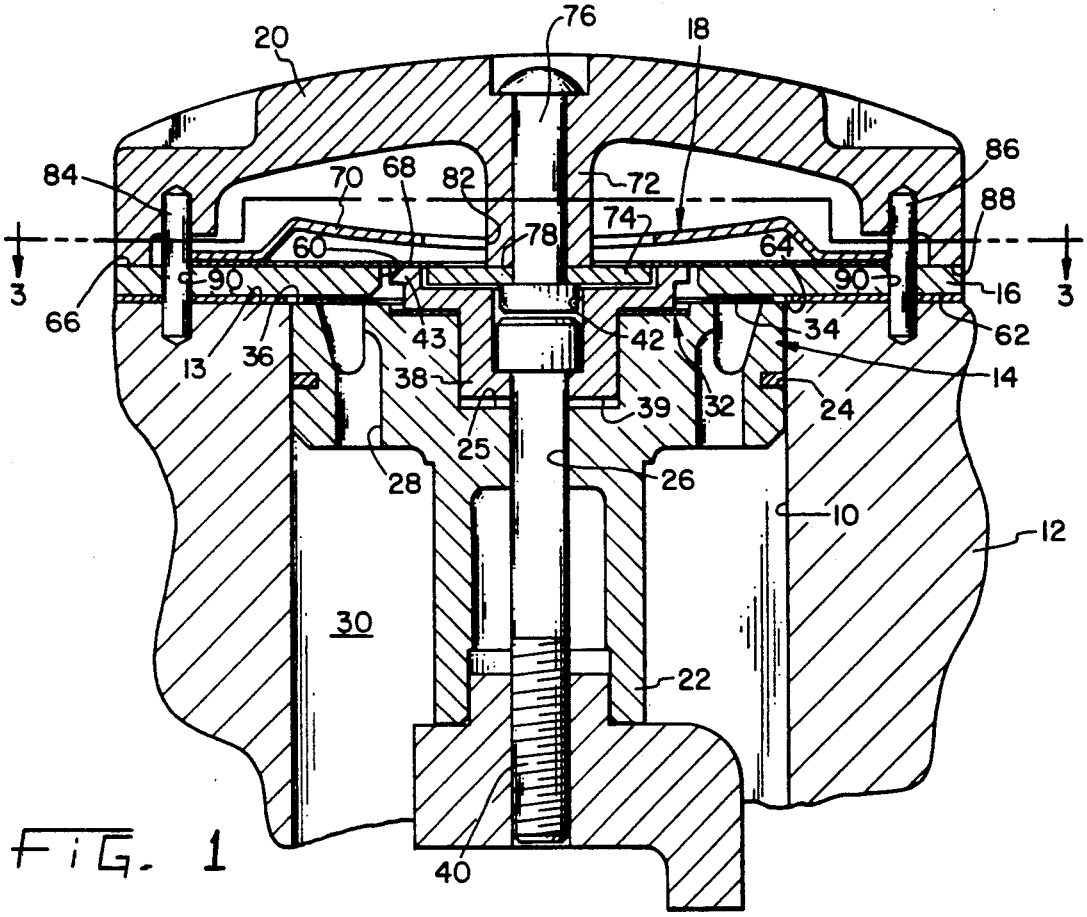
FIG. 1 is a fragmentary longitudinal sectional view of a scotch yoke compressor of the type to which the present invention pertains, particularly showing a low reexpansion valve system including a valved piston with in a cylinder, a valve plate, and a cylinder head, wherein the piston is at top dead center adjacent the valve plate and cylinder head.
Figure 3:
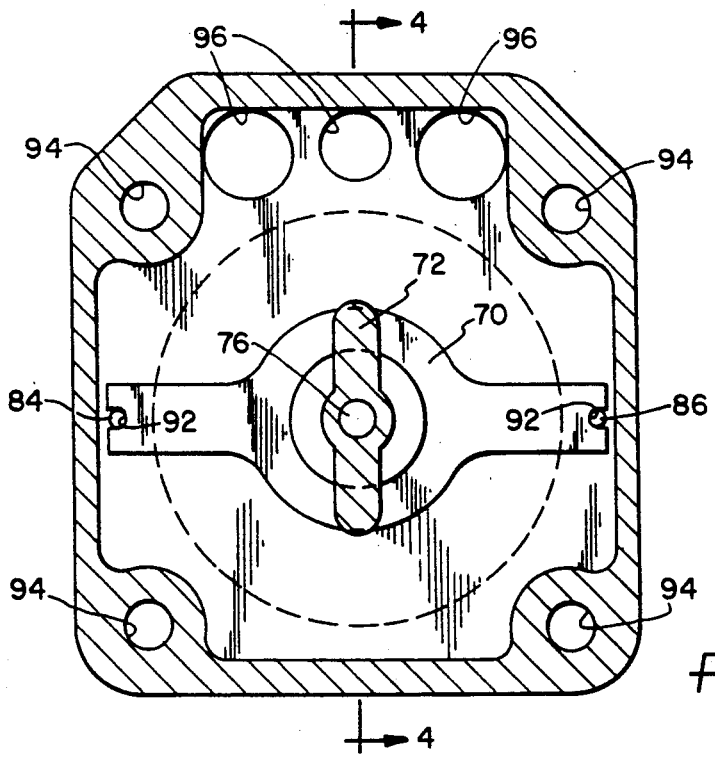
FIG. 3 is a transverse sectional view of the compressor of FIG. 1 taken through line 3—3 in FIG. 1 and viewed in the direction of the arrows.
Figure 2:
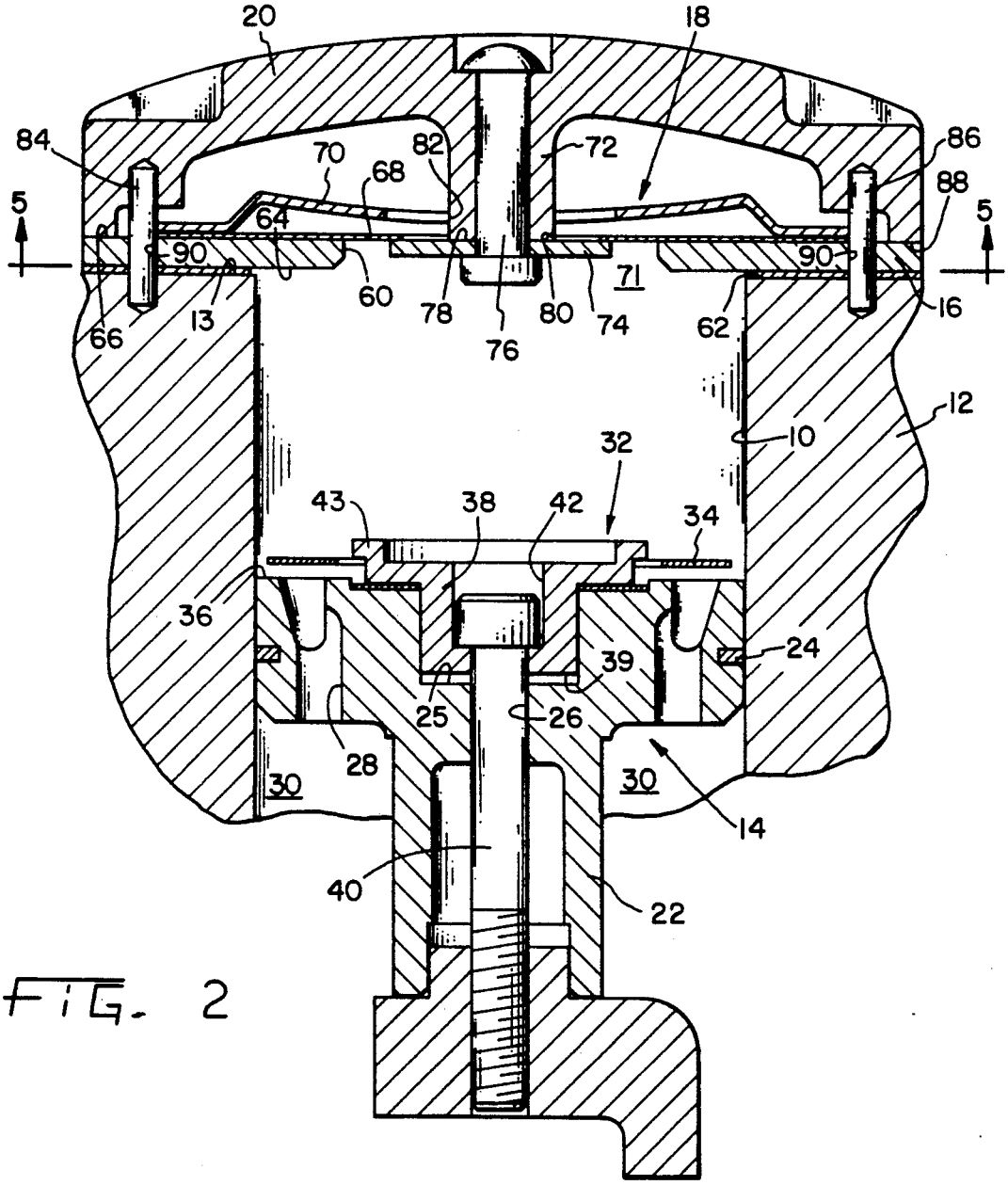
FIG. 2 is shows the valve system of FIG. 1 with the piston at bottom dead center within the cylinder.
Figure 4:
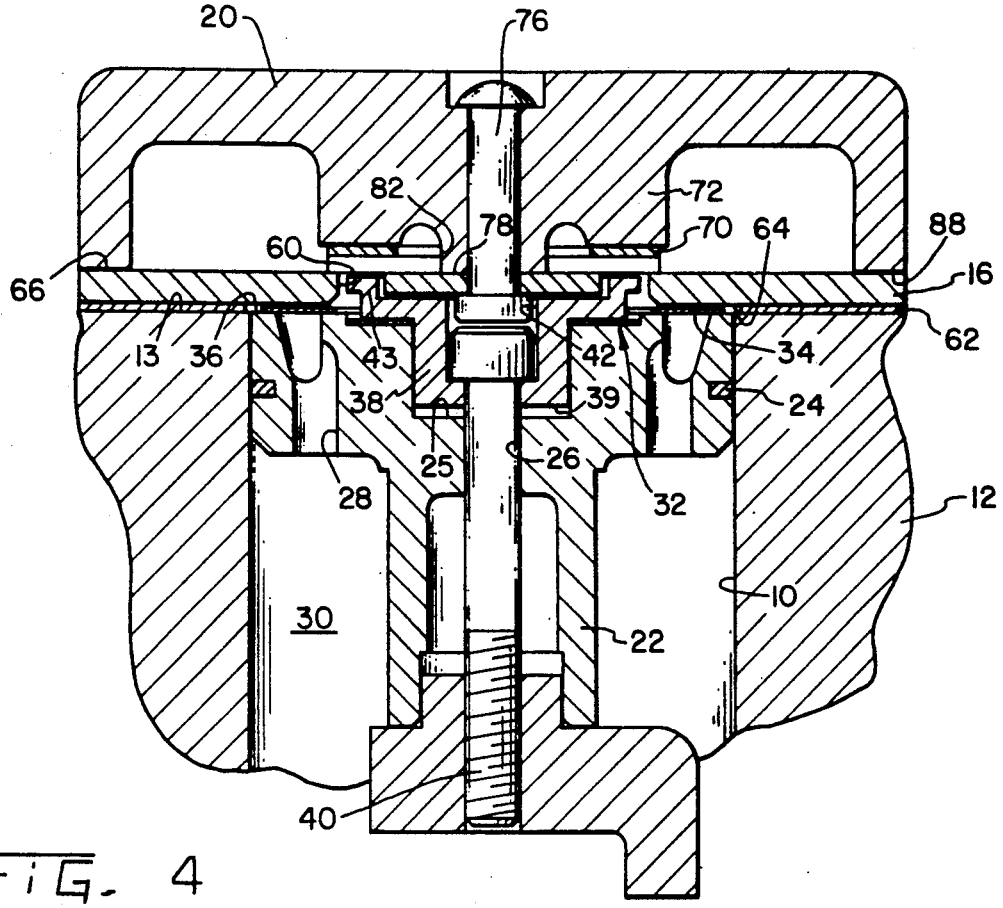
FIG. 4 is a longitudinal sectional view of the cylinder of FIG. 3 taken through line 4—4 in FIG. 3 and viewed in the direction of the arrows.
Figure 6:
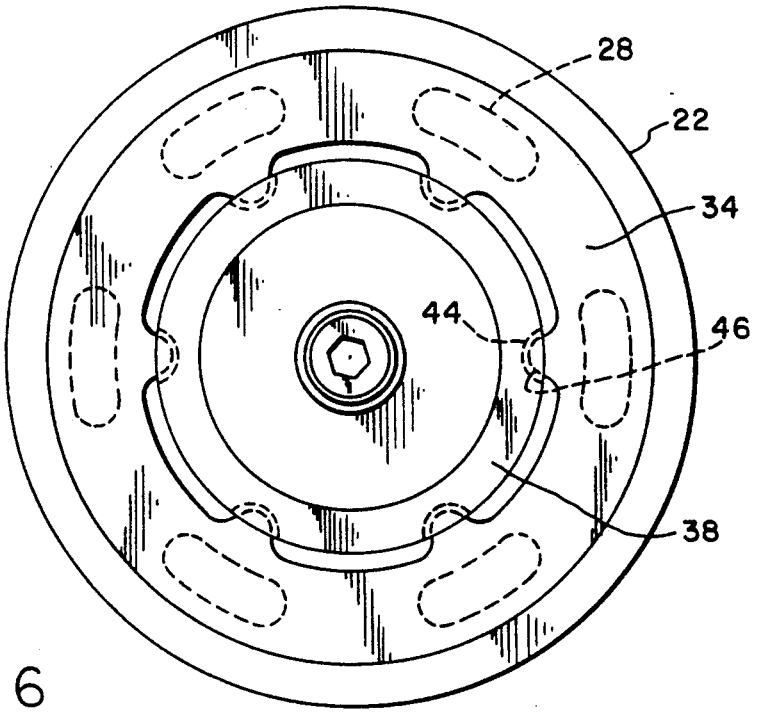
FIG. 6 is a top view of the valved piston of the compressor of FIG. 1, particularly showing the suction valve being indexed against rotation relative the suction valve retainer.

Referring now to FIGS. 1 and 2 there is shown one cylinder of a multi-cylinder scotch yoke compressor. This cylinder 10 has a sidewall formed by crankcase 12. Crankcase 12 has a top surface 13 onto which cylinder 10 opens. Inside the cylinder is a piston assembly 14. On the top surface 13 of crankcase 12 is a valve plate 16, discharge assembly 18, and cylinder head 20 which will be more thoroughly described herein.

Referring to piston assembly 14, piston assembly 14 comprises a piston 22 having an annular piston ring 24 to allow piston 22 to operably reciprocate within cylinder 10 to compress gaseous refrigerant therein. Referring more specifically to FIG. 2, piston 22 also includes a recess 25 with a mounting centerbore 26 extending through piston 22. A plurality of suction ports 28 are circularly arranged about centerbore 26 and extend through piston 22 to allow suction gas within suction cavity 30 to enter cylinder 10 on the compression side of piston 22.

In accord with the present invention, a suction valve assembly 32 is associated with piston assembly 14, and will now be described with respect to piston assembly 14 shown in FIGS. 1 and 2. Suction valve assembly 32 comprises a generally flat, disk-shaped suction valve 34. In its closed position, valve 34 covers suction ports 28 on outer top surface 36 of piston 22. Suction valve 34 opens and closes by virtue of fluid pressure forces and/or its own inertia as piston assembly 14 reciprocates in cylinder 10.

A suction valve retainer 38 is attached on outer top surface 36 of piston 22 by bolt 40. Specifically, a downward extending boss 39 is received within recess 25, and is retained therein by bolt 40, which also attaches piston 22 to the slide block of the scotch yoke mechanism. Suction valve retainer 38 has a counterbore 42 and an annular upwardly extending protuberance 43. Counterbore 42 not only receives the head of bolt 40 but, more importantly, enables valve retainer 38, which extends radially over suction valve 32, to receive discharge valve assembly 18 when piston assembly 14 is at top dead center. The annular protuberance 43 on top of suction valve retainer 38 is projected into an annular discharge port 71 when piston assembly is at top dead center. The interfitting arrangement of suction valve retainer 38 with annular discharge port 71 reduces the amount of reexpansion of refrigerant during compressor operation.

The suction valve 32 is indexed to prevent rotation by means of circumferentially arranged notches 44 in suction valve retainer 38 and corresponding radially inwardly extending projections 46 on the inner periphery of the annular suction valve 32.

Discharge valve assembly 18 is situated on top surface 66 of valve plate 16. Generally, compressed gaseous refrigerant within the cylinder 10 is discharged through annular discharge port 71 past an open discharge valve 68 that is limited in its travel by a discharge valve retainer 70. With reference to cylinder 10 in FIGS. 1 and 2, a cylinder head cover 20 is mounted to crankcase 12 with valve plate 16 interposed therebetween. Valve plate 16 has a central discharge opening 60 allowing communication between the cylinder 10 and the top surface 66 of valve plate 16. A valve plate gasket 62 is provided between valve plate 16 and crankcase 12.

Cylinder head cover 20 that fits over valve plate 16 has a suspended portion for defining, with opening 60 in valve plate 16, the aforementioned annular discharge port 71. More specifically, the suspended portion is a center boss 72 that is centered in discharge opening 60 of valve plate 16. Disk member, such as steel washer 74 and bolt 76 are attached to center boss 72 so that a top face 78 of washer 74 is substantially coplanar with the top surface 66 of valve plate 16. Discharge valve 68 is a flat, annular valve, having a central aperture 80. Valve 68 is made of thin valve steel and fits over portions of the top surface 66 of valve plate 16 and the top surface 78 of washer 74, which together comprise a discharge valve seat circumjacent annular discharge port 71. Valve retainer 70 is an annular, arcuate spring steel member corresponding substantially to the shape of discharge valve 68. Valve retainer 70 includes a central aperture 82.

A pair of guide pins 84, 86 extend from valve plate 16 to underside 88 cylinder head cover 20. For ease of assembly, guide pins 84, 86 are first press fit into a pair of holes 90 in valve plate 16 and are then captured within corresponding holes in cylinder head cover 20 as by a slip fit. The guide pins 84 and 96 may also fit in 20 holes in crankcase 12 as shown in FIGS. 1 and 2. Guide pins 84, 86 guidingly engage oval slots 92 in discharge valve retainer 70 at diametrically opposed locations therein.

Figure 5:
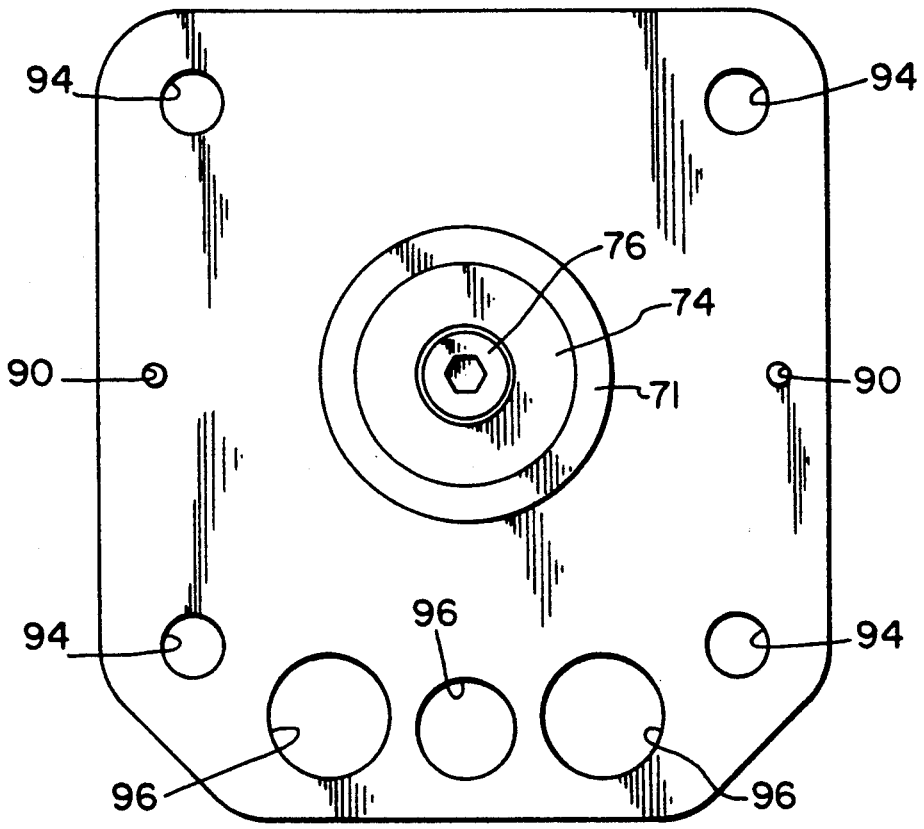
FIG. 5 is a bottom view of the valve plate and cylinder head assembly of the compressor of FIG. 1 taken along the line 5—5 in FIG. 2 and viewed in the direction of the arrows.

FIG. 5 shows a bottom view of valve plate 16 including the placement of the washer 74 creating an annular discharge port 71. Mounting holes 94 permit easy assembly with crankcase 12 and cylinder head 20 with bolts (not shown). Discharge holes 96 allow refrigerant at discharge pressure to flow from inside the cylinder head 20 to a discharge muffler system of the scotch yoke compressor (not shown).

Operation of a piston in a multi-cylinder scotch yoke compressor is well known. Significant reductions in reexpansion of refrigerant can be achieved by having a counterbore 42 on the suction valve retainer 38 that creates an annular protuberance that substantially fills the annular discharge port 71 when the piston assembly 14 is at top dead center.

It will be appreciated that the foregoing description of various embodiments of the invention is presented by way of illustration only and not by way of any limitation, and that various alternatives and modifications may be made to the illustrated embodiments without departing from the spirit and scope of the invention.

What is claimed is:

1. A compressor assembly for compressing refrigerant, comprising:

a crankcase including a cylinder therein, said crankcase having a substantially planar top surface onto which said cylinder opens;

a valve plate having a central opening extending therethrough, said valve plate being positioned adjacent said crankcase top surface such that said central opening provides communication between said cylinder and a top surface of said valve plate;

a cylinder head cover mounted to said crankcase top surface with said valve plate interposed therebetween, said head cover including suspended means for defining with said central opening an annular discharge port, respective portions of said valve plate and said suspended means immediately circumjacent said annular discharge port comprising a discharge valve seat;

a discharge valve assembly on said valve plate top surface, said discharge valve assembly including an annular discharge valve overlying said discharge valve seat;

a piston reciprocable in said cylinder to compress refrigerant, said piston having a plurality of circularly arranged suction ports through which refrigerant enters said cylinder for compression; and a suction valve assembly on a top face of said piston, said suction valve assembly including an annular suction valve overlying said suction ports and valve retainer means on which said suction valve slides for limiting displacement of said suction valve away from said top face of said piston, said valve retainer means including an annular protuberance that extends radially over said suction valve to engage and limit movement of said suction valve, said annular protuberance substantially fills said annular discharge port when said piston is at its top dead center position, whereby reexpansion volume due to said annular discharge port is minimized.

2. The compressor assembly of claim 1 in which said suspended means comprises a generally planar disk member attached to said cylinder head, said disk member having a top surface generally coplanar with said valve plate top surface.

3. The compressor assembly of claim 2 in which said disk member comprises a steel washer connected by a bolt to said cylinder head.

4. The compressor of claim 1 in which said suction valve includes index means for preventing rotation of said suction valve relative said valve retainer means.

5. The compressor of claim 4 in which said index means comprises a plurality of notches in said valve retainer means and a corresponding plurality of radially inwardly extending projections on the inner periphery of said suction valve.

6. The compressor of claim 1 in which said valve retainer means includes a counterbore in which a portion of said annular discharge valve assembly is received.

7. A compressor assembly for compressing refrigerant, comprising:

a crankcase including a cylinder therein, said crankcase having a substantially planar top surface onto which said cylinder opens;

a piston, reciprocable in said cylinder, having a plurality of suction ports through which refrigerant enters said cylinder;

a valve plate having substantially planar top and bottom surfaces, said valve plate being attached to said crankcase top surface to thereby close said cylinder, said valve plate including a central annular discharge opening extending throughout and communicating with a valve seat on said valve plate top surface;

a cylinder head cover including a discharge valve seat washer having top and bottom surfaces, said valve seat washer being centrally fastened to said cylinder head cover by a bolt having a bolt head adjacent said bottom surface of said valve seat washer, said valve seat washer being suspended within said annular discharge opening, said valve seat washer top face being generally planar with said valve plate top surface;

a discharge valve assembly on said valve plate top surface, said discharge valve assembly comprising an annular discharge valve member overlying said valve seat and said washer; and a suction valve assembly connected to the top face of said piston, said suction valve assembly comprising an annular suction valve member displaceable a fixed distance from said top face over said suction ports, and a suction valve retainer having a counterbore to accommodate said valve seat washer and bolt head, said suction valve retainer extending above said annular suction valve member.

8. A compressor of claim 7 in which said suction valve member includes index means for preventing rotation of said suction valve member relative said suction valve retainer.

9. A compressor of claim 8 in which said index means comprises a plurality of notches in said suction valve retainer and a corresponding plurality of radially inwardly extending projections on the inner periphery of said suction valve member.

* * * * *